US005750919A

United States Patent [19]

Jehle

[11] Patent Number: 5,750,919

[45] Date of Patent: May 12, 1998

[54] SELF-ADJUSTING OBTURATOR FOR PROJECTILE LAUNCHING

[75] Inventor: Robert E. Jehle, Silver Spring, Md.

[73] Assignee: The United States of America as represented by the Secretary of the Navy, Washington, D.C.

[21] Appl. No.: 18,125

[22] Filed: Feb. 16, 1993

[51] Int. Cl.[6] ..... F42B 14/00

[52] U.S. Cl. ..... 102/532; 102/520

[58] Field of Search ..... 102/435, 439, 102/520–527, 532; 42/74

[56] References Cited

U.S. PATENT DOCUMENTS

| | | | |
|---|---|---|---|
| H296 | 7/1987 | Zabel | 102/521 |
| 37,361 | 6/1863 | Ritner . | |
| 315,102 | 4/1885 | Williams | 102/532 |
| 634,101 | 10/1899 | Ashton | 102/532 |
| 1,899,925 | 3/1933 | Brofelth . | |
| 1,903,657 | 4/1933 | Reed . | |
| 2,073,609 | 3/1937 | Court . | |
| 2,672,814 | 3/1954 | Dubost . | |
| 3,037,313 | 6/1962 | Gring, Jr. | 42/74 |
| 3,053,185 | 9/1962 | Oberfell et al. . | |
| 3,191,534 | 6/1965 | Vecchiotti | 102/532 |
| 4,043,267 | 8/1977 | Hayashi . | |

FOREIGN PATENT DOCUMENTS

| | | | |
|---|---|---|---|
| 124178 | 9/1967 | Czechoslovakia | 102/532 |
| 580461 | 11/1924 | France | 102/461 |
| 1116967 | 5/1956 | France | 102/532 |
| 1258333 | 3/1961 | France | 102/532 |
| 1384067 | 11/1964 | France | 102/532 |
| 349902 | 12/1960 | Switzerland | 102/532 |
| 12537 | 6/1890 | United Kingdom | 102/450 |

*Primary Examiner*—Harold J. Tudor
*Attorney, Agent, or Firm*—John Forrest; Jacob Shuster

[57] ABSTRACT

Propellant pressure forces generated within the bore of a gun barrel are applied to a projectile through a self-adjusting obturator to prevent projectile blow by of propellant explosion products. The propellant forces are transmitted through a body of shock-absorbing fluid in the obturator protectively isolated from surfaces of the barrel and projectile by a non-porous, flexible enclosure wall deformed into sliding contact with the barrel bore during projectile launch for preventing propellant pressure loss.

5 Claims, 1 Drawing Sheet

SELF-ADJUSTING OBTURATOR FOR PROJECTILE LAUNCHING

BACKGROUND OF THE INVENTION

The present invention relates to the launching of projectiles from the bore of a gun barrel in response to propellant forces exerted on the projectile by expanding propellant gases.

In the foregoing type of projectile launching arrangement, leakage or blow by of propellant gases past the projectile has been prevented by a radially expandable wad type of obturator positioned in the barrel bore in rearward abutment with the projectile, as disclosed for example in U.S. Pat. Nos. 37,361 and 1,903,657 to Ritner and Reed, respectively. The use of radially expansible obturators positioned on the projectile itself, is disclosed on the other hand in U.S. Pat. No. 2,672,812 to Dubost and in U.S. Statutory Registration No. H296 to Zabel. In all of such prior art obturator arrangements, the radially expandable wad is made of a solid material pressed into direct contact with the wall surfaces of the barrel bore. With wear of the barrel, especially at locations therein approaching its breech end, the wad fits less snugly so that propellant gas blow by occurs thereby accounting for propellant gas pressure loss and a reduction in projectile launch velocity.

It is therefore an important object of the present invention to provide an obturator arrangement for projectile launching which will accommodate barrel wear without introducing any adverse affects.

An additional object of the invention in accordance with the foregoing object is to provide an obturator arrangement capable of being calibrated to accommodate different types and sizes of projectile launching systems.

SUMMARY OF THE INVENTION

In accordance with the present invention a body of fluid is confined to a chamber within the barrel bore of a projectile launcher, said chamber being defined within a deformable spacer protectively isolating the fluid from the barrel and the projectile. Propelling gas pressure forces generated for example by ignition of a propellant cartridge within the barrel are transferred to the projectile through the confined body of fluid to develop therein hydrostatic forces distributed to the outer flexible wall of the deformable spacer causing it to deform into intimate sliding contact with the barrel bore during launch to effectively prevent leakage of propellant gases past the projectile. Loss of propellant gas pressure exerting propelling forces on a stiff pusher plate in interfacing abutment with the flexible spacer, is thereby avoided.

Pursuant to the present invention, the outer flexible wall of the deformable spacer is non-porous so as to act as a protective barrier confining the fluid therein. Thus, the characteristics of a fluid as a shock-absorbing medium may be utilized without adverse affects of direct surface contact. Such flexible wall is furthermore provided at its end in abutment with the interface pusher plate with a more rigid stop formation projecting into the fluid chamber to control distribution of hydrostatic forces developed during launch, thereby limiting the self-adjusting capability of the described obturator device to a desired extent in accommodating wear of the barrel.

BRIEF DESCRIPTION OF DRAWING

Other objects, advantages and novel features of the invention will become apparent from the following detailed description of the invention when considered in conjunction with the accompanying drawing wherein.

DETAILED DESCRIPTION OF PREFERRED EMBODIMENTS

Figure 1A:
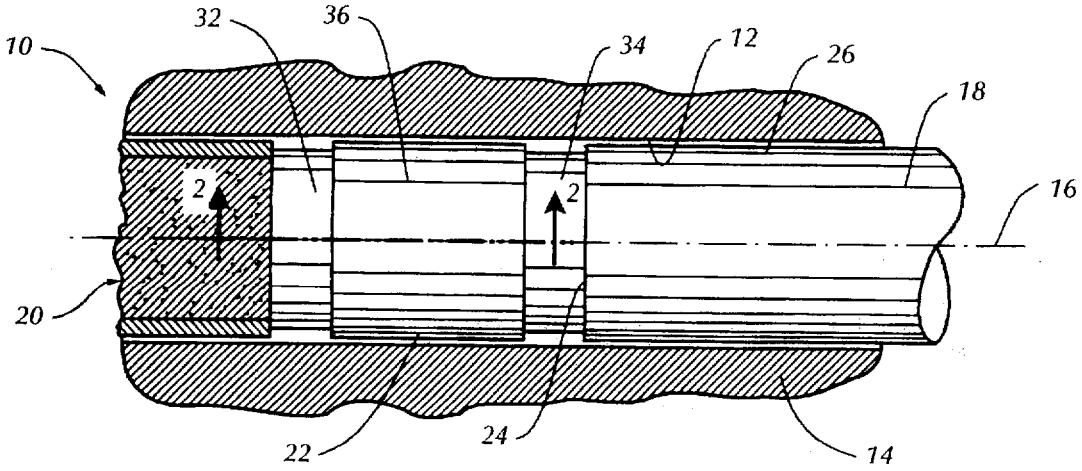
FIG. 1A is a partial side section view through a projectile launcher showing the obturator device of present invention in position within the barrel bore prior to projectile launch.
Figure 1B:
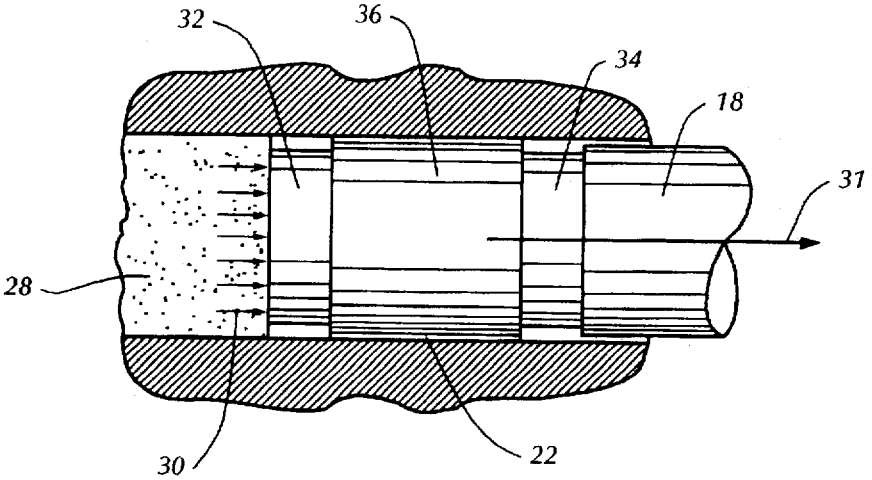
FIG. 1B is a partial side section view similar to FIG. 1A, depicting the obturator device during projectile launch.

Referring now to the drawing in detail, FIG. 1A illustrates a launching device, generally referred to by reference numeral 10, having a bore 12 formed in a gun barrel 14 through which a launching path is established along the bore axis 16. The rear end portion of a projectile 18 is shown in FIG. 1A within the bore 12, prior to ignition of a propellant cartridge 20. Ignition of the propellant cartridge causes launch of the projectile under pressure of resulting propellant gases 28 as shown in FIG. 1B. The propellant cartridge 20 is accordingly spaced rearwardly of the projectile 18 within the bore along axis 16 as shown in FIG. 1A, prior to launch. Pursuant to one embodiment of the present invention, a self-adjusting obturator assembly 22 is disposed within the bore 12 of barrel 14 between the propellant cartridge 20 and the rear end 24 of the projectile 18.

As will be observed in FIG. 1A, an annular passage 26 is formed about the projectile 18 and the obturator assembly 22 within the barrel 14. The radial extent of such passage 26 will be dependent on wear of the bore surfaces and/or variations in bore geometry. Such passage 26 is closed or sealed by deformation of the obturator assembly 22 during launch as shown in FIG. 1B, in order to block leakage flow of propellant gases 28 past the projectile. Accordingly, substantially all of the propellant gas pressure forces 30 generated by ignition of the propellant cartridge are exerted on one axial end of the obturator assembly 22 as shown in FIG. 1B, for transfer therethrough to the end 24 of the projectile resulting in pushing or displacement of the projectile with the obturator assembly in trailing abutment therewith during travel in the direction of launch 31.

The obturator assembly 22 in the illustrated embodiment includes a pair of interface pusher plates 32 and 34 made of a relatively stiff or rigid material. The plates 32 and 34 are respectively in contact with the propellant cartridge 20 and the rear end 24 of the projectile. A deformable spacer 36 is disposed within the bore between and in axial abutment with the interface pusher plates for transmitting propellant forces to the projectile. Accordingly, during travel of the projectile induced by the propellant forces, the spacer 36 is radially expanded outwardly beyond the interface plates for intimate sliding contact with all surfaces of bore 12 to close and substantially block flow of propellant gases through the passage about the projectile as shown in FIG. 1B.

Figure 2:
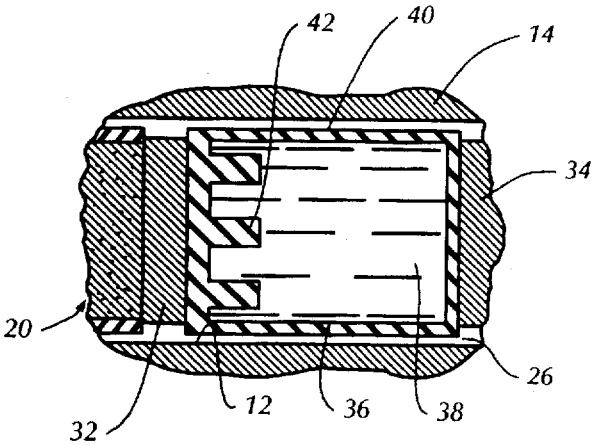
FIG. 2 is an enlarged section view taken substantially through a plane indicated by section line 2—2 in FIG. 1A.

The spacer 36 of the obturator assembly as shown in FIG. 2 includes a body of shock-absorbing material 38 in a fluid state, such as a hydrostatic liquid. The liquid may be water, alcohol or non-solid viscous liquids as well as mixtures thereof. Such body of shock-absorbing fluid 38 is confined to a substantially cylindrical chamber isolated from the walls of the barrel bore 12 by a protective barrier in the form of a thin flexible enclosure wall 40 made of a material such as rubber that is non-porous with respect to the fluid 38. Thus, in response to the transfer of the propellant forces 30 through the spacer 36, the body of fluid is radially expanded as propellant forces exerted on the end 24 of the projectile meet resistance to forward travel. The foregoing action of the propellant forces on the body of fluid 38 squeezes or deforms the spacer 36 until its outer flexible wall 40 comes into intimate sliding contact with all surrounding wall surfaces of the barrel bore 12. The expanding propellant gases 28, as shown in FIG. 1B, are thereby effectively sealed off from passage 26 about the projectile so that little blow by occurs and substantially the full force of the expanding gases is used to move or propel the projectile in the travel direction 31.

The specific dimensions and particular selection of materials for the foregoing described components of the obturator assembly 22 will of course be determined by the particular barrel bore size, propellant gas pressure, temperature and propellant ignition explosion chemistry products. As the size of the barrel bore 12 increases because of wear, the deforming action of the spacer 36 will self-adjust so as to maintain the gas sealing function of its outer flexible wall 40. In accordance with the embodiment illustrated in FIG. 2, such self-adjusting capability of enclosure wall 40 is limited by deliberate design so that propellant gas pressure in the barrel 14 and muzzle velocity of the projectile 18 decreases during launch when and if the self-adjustment limit is exceeded.

As shown in FIG. 2, a plurality of island stop formations 42 project inwardly into the fluid confining chamber enclosed by outer wall 40 from its end portion in abutment with interface plate 32. The fluid 38 confined to the chamber surrounds the stop formations 42 to thereby affect distribution of internal hydrostatic fluid forces (developed during spacer deformation) to the wall 40 of the spacer 36. The lengths of the stop formations 42 are accordingly calibrated to establish the aforementioned self-adjustment limit of the obturator assembly 22 accommodating bore wear.

Figure 3:
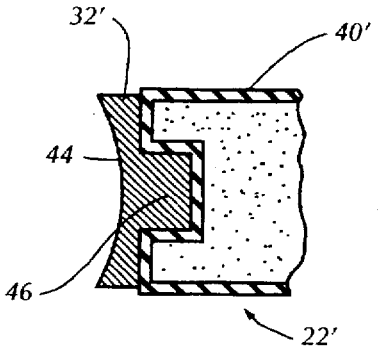
FIG. 3 is a partial section view of a modified portion of the obturator device depicted in FIG. 2.

FIG. 3 illustrates certain features of a modified form of obturator assembly 22' having an outer flexible wall 40' for the spacer in axial abutment at one end with a stiff interface plate 32'. As shown, the interface plate 32' has an arcuate end face 44 to which the propellant gas forces are applied. The axial end of plate 32' opposite face 44 is provided with a rigid plug portion 46 acting as a backing to rigidify a single stop formation projecting from the end portion of flexible enclosure wall 40' isolating the body of shock-absorbing fluid 38' from the barrel bore. Such interface mounted stop formation functions to limit the self-adjustment capability of the obturator assembly 22' of FIG. 3, as hereinbefore explained with respect to the obturator assembly 22 illustrated in FIG. 2. FIG. 3 also shows the shock-absorbing fluid 38' to be in the form of a gas. It should be appreciated that the shock-absorbing fluid could also be a mixture of hydrostatic liquids and gases.

Although FIGS. 1–2 show the obturator assembly 22 as including an interface plate 34 in abutment with the end 24 of projectile 18, elimination of such plate 34 in favor of cooperating structure on the abutting end of the projectile is contemplated. It is also reiterated at this point that use of the present invention with different types of projectiles is contemplated, including those where the protective barrier characteristics of the flexible spacer wall material becomes even more critical. In addition to isolating the chamber confined, shock-absorbing fluid from the wall surfaces of the barrel bore, the non-porous nature of the enclosure wall material will provide protection for the rear end portions of those types of projectiles having exposed antennae and/or optical means.

Numerous other modifications and variations of the present invention are possible in light of the foregoing teachings. It is therefore to be understood that within the scope of the appended claims the invention may be practiced otherwise than as specifically described.

What is claimed is:

1. In combination with a launcher having a barrel bore through which a projectile is displaced propellant forces, obturator means disposed within the barrel bore for sealing gas passages between the barrel bore and the projectile during launch, said obturator means including interfacing means for transmitting the propellant forces to the projectile, a body of shock-absorbing fluid and flexible barrier means for isolating the body of shock-absorbing fluid within the barrel bore during gas sealing deformation into contact therewith in response to transfer of the propellant forces exerted on said interfacing means during said launch, said interfacing means comprising at least one relatively rigid pusher plate in abutment with the flexible barrier means, said flexible barrier means being made of a material that is non-porous with respect to the shock-absorbing fluid and said shock-absorbing fluid being a mixture of viscous liquid and gas.

2. In combination with a launcher having a barrel bore through which projectile is displaced by propellant forces, obturator means disposed within the barrel bore for sealing gas passages between the barrel bore and the projectile during launch, said obturator means including interfacing means for transmitting the propellant forces to the projectile, a body of shock-absorbing fluid, flexible barrier means for isolating the body of shock-absorbing fluid, within the barrel bore during gas sealing deformation into contact therewith in response to transfer of the propellant forces exerted on said interfacing means during said launch, said flexible barrier means including a deformable wall enclosing a chamber within which the shock-absorbing fluid is confined, said wall being in contact with the interfacing means, and stop means projecting from said wall into the chamber for limiting said gas sealing deformation of the flexible barrier means.

3. The combination of claim 2 wherein said interfacing means includes at least one pusher plate in abutment with said flexible barrier means.

4. The combination of claim 3 wherein the interfacing means further includes a rigid formation projecting from the pusher plate into the stop means for rigidification thereof.

5. In an obturator device for a barrel from which a projectile is launched, a body of fluid, protective barrier means enclosing a chamber within which the body of is confined for isolation thereof from the barrel and the projectile, and pressure responsive means transmitting propelling forces to the projectile through the body of fluid for expansion of the barrier means into sliding contact with the barrel to block flow of propellant through the barrel during said launch of the projectile, the pressure responsive means comprising a wall portion of the protective barrier means deformed into said sliding contact with the barrel and means projecting from said wall portion into the chamber for controlling distribution of hydrostatic forces developed in the fluid during transfer of the propelling forces therethrough.

* * * * *